United States Patent [19]

Schreiber

[11] 4,016,982

[45] Apr. 12, 1977

[54] HOLDER FOR A WRITING IMPLEMENT

[75] Inventor: Klaus-Günther Schreiber, Hamburg, Germany

[73] Assignee: Messrs. Berendsohn AG, Hamburg, Germany

[22] Filed: June 3, 1975

[21] Appl. No.: 583,243

[30] Foreign Application Priority Data

June 20, 1974 Germany ..... 7420963[U]

[52] U.S. Cl. ..... 211/69.1; 248/359; 401/131

[51] Int. Cl.[2] ..... B43K 23/04

[58] Field of Search ..... 248/359, 346, 44, 350, 248/176, 314; 401/131; 240/81 R, 81 BC, 81 C; 211/69.1, 69.5–69.7

[56] References Cited

UNITED STATES PATENTS

| | | | |
|---|---|---|---|
| 2,005,826 | 6/1935 | Kulp et al. | 248/44 |
| 2,632,320 | 3/1953 | Liss | 248/314 X |
| 2,646,243 | 7/1953 | Rycroft | 248/314 |
| 2,827,879 | 3/1958 | Rosa | 211/69.7 |
| 3,286,695 | 11/1966 | Martin | 401/131 |
| 3,388,249 | 6/1968 | Siegel et al. | 248/20 G |

FOREIGN PATENTS OR APPLICATIONS

| | | | |
|---|---|---|---|
| 25,500 | 5/1908 | Sweden | 211/69.1 |
| 132,621 | 8/1951 | Sweden | 211/69.5 |

*Primary Examiner*—Roy D. Frazier
*Assistant Examiner*—Robert W. Gibson, Jr.
*Attorney, Agent, or Firm*—Stevens, Davis, Miller & Mosher

[57] ABSTRACT

A writing element is detachably, or non-detachably, connected to an elongate holder which can be bent by hand into any desired shape to remain in that shape. The holder consists of a core made of a flexible metal such as lead and is covered with a flexible covering such as a covering of a plastics material.

3 Claims, 1 Drawing Figure

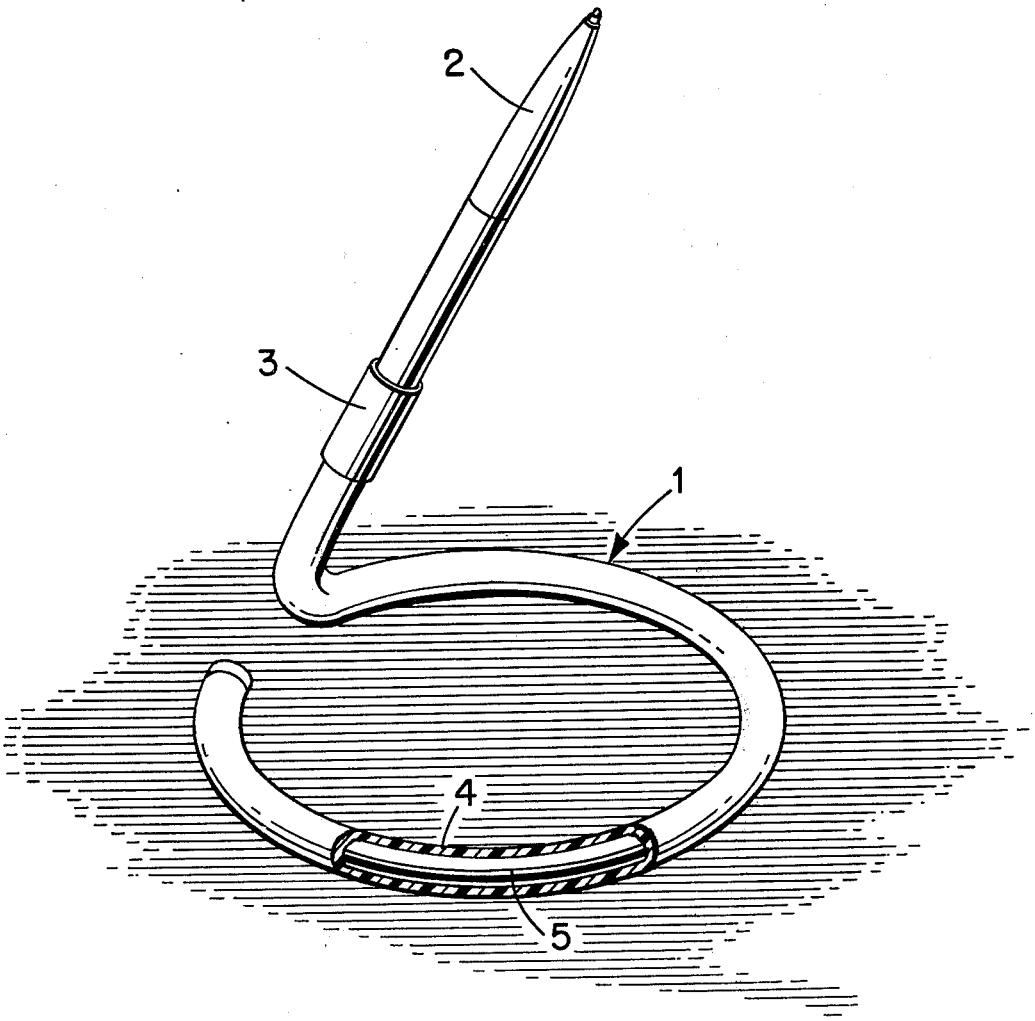
2
3
1
4
5

HOLDER FOR A WRITING IMPLEMENT

BACKGROUND OF THE INVENTION

1. Field of the Invention

The invention relates to a holder for and the combination therewith of a writing implement.

2. Description of the Prior Art

Various kinds of holders for writing implements are known in which sleeves adapted to be moved to various positions are provided to hold the writing implement. One known type of holder of this kind comprises a plate which can be placed on a support and on which a sleeve for temporarily receiving a writing implement is mounted for swivelling to various positions by means of a ball joint.

In other types a holder is provided which is adapted to be secured by adhesion to a wall or the like, and which by means of a ball joint carries a sleeve for temporarily holding a writing implement.

In another type of known holder a flexible part is provided between the sleeve temporarily receiving a writing implement and a foot, for example in the form of a suction foot, in order to enable the sleeve to be brought into any desired position.

The problem underlying the invention is that of so constructing holders for writing implements, in respect of their shape and design, that a writing implement can be disposed in any desired position by the simplest means, while it is also possible for the holder for the writing implement, or the holder together with a writing implement, to be hung up when desired.

SUMMARY

For a holder for a writing implement the solution of the problem consists according to the invention in constructing a holder for a writing implement in the form of a rod, the material of which is so selected that the rod by hand can be bent into any desired shape and will remain in that shape. The writing implement may be detachably or non-detachably connected to the holder.

When the connection between the actual writing implement and the holder is detachable, a sleeve may be provided in a manner known per se at one end of the holder for the purpose of temporarily receiving the writing implement.

In another embodiment of the invention the actual writing implement is fastened to the holder for the writing implement. This embodiment makes it possible for parts of the holder, or the holder itself, to be utilised during writing as part of the writing implement itself.

An advantage gained by the invention consists particularly in that the holder in the form of a rod can be easily bent by hand into any desired shape, so that parts of the holder can be used for standing on a support, or that, for example, parts of the holder can be bent into the shape of a hook or the like, so that the writing implement together with the holder, or the holder without the writing implement, can be hung on a hook.

Another advantage of a holder provided with a writing implement or for a writing implement according to the invention is that it can satisfy the user's instinct to play, since during a conference or during dictation the user of the writing implement can play with the holder and bend it by hand into any desired different shapes.

Another advantage achieved by the invention consists in that the rod-shaped holder, which can be bent into various positions, can at the same time be used as a pointer, for example for explaining drawings on a wall, if the holder is brought into a substantially straight shape.

There are various possible methods for the practical construction of a holder according to the invention, either for a writing implement or provided with a writing implement.

In one embodiment of the invention the actual holder consists of an easily bendable core of a flexible metal and of a flexible covering enclosing the core.

In one practical embodiment of the invention the holder consists of a piece of wire made of lead and coated with a deformable plastics material.

Preference is given to an embodiment in which the holder is fastened to the actual writing implement, in such a manner that the writing implement and the holder form an integral unit, so that the writing implement is practically unloseable. It is, however, also possible for a detachable connection to be provided between the holder and the writing implement, and for this purpose one end of the holder may be provided with a sleeve into which the writing implement can be inserted when not in use.

BRIEF DESCRIPTION OF THE DRAWING

The drawing shows in perspective one form of construction of a holder according to the invention connected to a writing implement.

DESCRIPTION OF THE PREFERRED EMBODIMENT

Referring to the drawing, the holder 1 has the form of a flexible wire, which consists of a core of a flexible metal 5, for example lead, and of a flexible covering 4, for example of a deformable plastics material. To one end of the holder 1 is attached a writing implement designated 2, which may be fastened to the holder 1.

It is also possible to provide at one end of the holder 1 a sleeve 3, into which the writing implement 2 can be inserted with a friction fit and from which it can be detached.

In the embodiment illustrated a part of the holder 1 is formed into a curve in one plane, so that the holder 1 forms a foot to stand on a desk or the like, while the end of the holder points upwards and, in the embodiment last described, can receive the writing implement in any desired position.

Since with the holder of the invention it is possible to bend the holder into any desired shape, when the writing implement is to be used it is possible to bent parts of the holder so that they lie in line with the longitudinal axis of the writing implement, or else parts of the holder may be disposed parallel to the writing implement, in such a manner that parts of the holder themselves form parts of the writing implement during writing. In an embodiment of the invention of this kind it is possible for the writing implement to be made comparatively very short, since parts of the holder serving for the insertion of the writing implement can be used as support between the thumb and forefinger.

I claim:

1. A holder in connection with a writing implement, the holder comprising an elongated part being non-detachably connected to the writing implement and being bendable into any shape and to remain in that shape when being bent, said elongated bendable part consisting of a core of material easily bendable by hand and a covering for said core of a material easily bendable by hand.

2. The holder according to claim 1, wherein said core is of metal.

3. The holder according to claim 1, wherein said core is of lead and said covering is of flexible plastics material.

* * * * *